US008328451B1

(12) United States Patent
Atkin

(10) Patent No.: US 8,328,451 B1
(45) **Date of Patent: *Dec. 11, 2012**

(54) DEHYDRATED DENTIFRICE AND TOOTHBRUSH

(76) Inventor: Joshua D Atkin, Beavercreek, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/052,692

(22) Filed: Mar. 21, 2011

Related U.S. Application Data

(63) Continuation of application No. 12/501,857, filed on Jul. 13, 2009, now Pat. No. 7,931,418, which is a continuation of application No. 11/818,316, filed on Jun. 14, 2007, now Pat. No. 7,575,387.

(60) Provisional application No. 60/813,383, filed on Jun. 14, 2006.

(51) Int. Cl.
*A46B 11/00* (2006.01)

(52) U.S. Cl. ..... 401/268; 401/132

(58) Field of Classification Search ..... 401/118, 401/119, 123, 268, 270, 132
See application file for complete search history.

(56) References Cited

U.S. PATENT DOCUMENTS

| | | | |
|---|---|---|---|
| 1,995,374 | A | 3/1935 | Young |
| 2,043,898 | A | 6/1936 | Malcolm |
| 2,263,982 | A | 11/1941 | Wolcott |
| 2,307,493 | A | 1/1943 | Davidson |
| 2,778,045 | A | 1/1957 | Bly et al. |
| 4,503,871 | A | 3/1985 | Mendenhall |
| 4,963,046 | A | 10/1990 | Eguchi |
| 5,065,470 | A | 11/1991 | Diamond |
| 5,655,249 | A | 8/1997 | Li |
| 5,888,010 | A | 3/1999 | Laux |
| 6,004,059 | A | 12/1999 | Zaccaria |
| 6,715,952 | B1 | 4/2004 | Aiken |
| 6,845,883 | B2 | 1/2005 | Pieri |
| 7,331,731 | B2 | 2/2008 | Hohlbein et al. |

*Primary Examiner* — David Walczak

(74) *Attorney, Agent, or Firm* — Curatolo Sidoti Co., LPA; Salvatore A. Sidoti; Julie D. Hawk

(57) ABSTRACT

A toothbrush has one or two part-spherical pockets formed in the brush surface. Balls or pellets of matching shape of dehydrated toothpaste are placed in the depressions, the brush is wetted and the pellets turn to a gel, ready for brushing. The pellets may be of various colors and flavors to entice children to brush their teeth and may be dispensed from a storage chamber carried in the tooth brush handle.

13 Claims, 3 Drawing Sheets

DEHYDRATED DENTIFRICE AND TOOTHBRUSH

CROSS REFERENCE TO RELATED APPLICATIONS

This application is a continuation of U.S. Ser. No. 12/501,857, filed on Jul. 13, 2009, now U.S. Pat. No. 7,931,418, which is a continuation of U.S. Ser. No. 11/818,316, filed on Jun. 14, 2007, now U.S. Pat. No. 7,575,387 that is hereby incorporated by reference, which claims priority of U.S. Provisional Patent Application Ser. No. 60/813,383, filed Jun. 14, 2006.

TECHNICAL FIELD

This invention relates to dental cleaning system and, more particularly, to a dentifrice and a toothbrush adapted to use the dentifrice.

BACKGROUND OF THE INVENTION

Many patents have been issued directed to the use of a dehydrated dentifrice or toothpaste. Among the uses of this dehydrated dentifrice is pre-coating a disposable toothbrush, as in 4963046-Eguchi. and 6715952-Aiken et al. In 5888010-Laux, dried toothpaste is coiled in the handle of a toothbrush and fed onto position atop the bristles.

In addition, many patents have been issued which purport to present implements which make tooth brushing attractive to children to promote regular tooth brushing habits. Such a patent having brush bristles impregnated with edible dehydrated toothpaste is 6004059-Zaccaria. A recent patent—6845883-Pieri provides a specially-packaged strip of individual pre-measured sachets of dentifrice to aid developing children's good brushing habits.

Toothbrushes having a variety of bristle contours, shapes and arrangements have been developed. Among these are those disclosed in 5655249-Li, 5065470-Diamond, and 2043898-Malcolm.

There is a need for a toothbrush and dentifrice combination that makes teeth brushing attractive for children that has pre-measured amounts of dentifrice which does not require special packaging and has a toothbrush that accommodates the pre-measured amounts of dentifrice. There is also a need for a tooth brush and dentifrice combination that is compact for travel, such as camping.

SUMMARY OF THE INVENTION

It is therefore an object of this invention to provide a dental cleaning system comprising a toothbrush and dentifrice combination that makes teeth brushing attractive for children.

It is another object to provide a dental cleaning system that has pre-measured amounts of dentifrice which do not require special packaging and has a toothbrush that accommodates the pre-measured amounts of dentifrice.

It is a further object to provide a dentifrice which is in solid form, for ease of handling, and turns to a gel when wetted for ease of teeth cleaning.

It is a yet further object to provide a tooth brush and dentifrice combination that is compact for travel, such as camping.

In one aspect this invention features a dental cleaning system comprising a toothbrush having one or two half-round pockets in the bristle face. Balls or pellets of solid dehydrated toothpaste having a matching shape are placed in the pockets, the brush is wetted and the pellets turn to a gel—ready for brushing. The pellets may be of various colors and flavors to entice children to brush their teeth and may be dispensed from a reservoir carried in the tooth brush handle.

These and other objects and features of this invention will become more readily apparent upon reference to the following detailed description of a preferred embodiment, as illustrated in the accompanying drawings, in which:

DESCRIPTION OF THE PREFERRED EMBODIMENT

Figure 1:
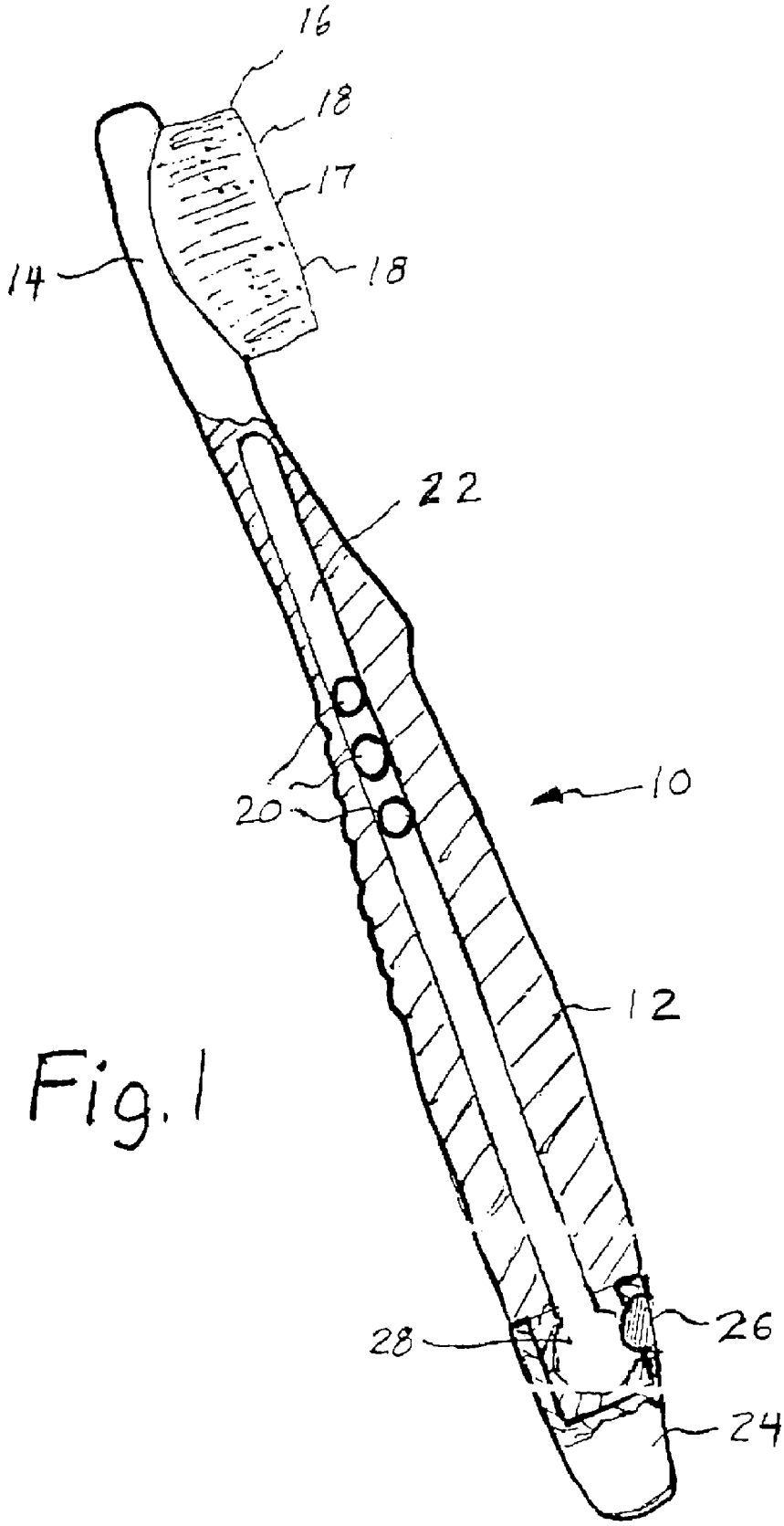
FIG. 1 is a side view of a tooth brush according to this invention, partially broken away to enhance understanding of its construction.
Figure 2:
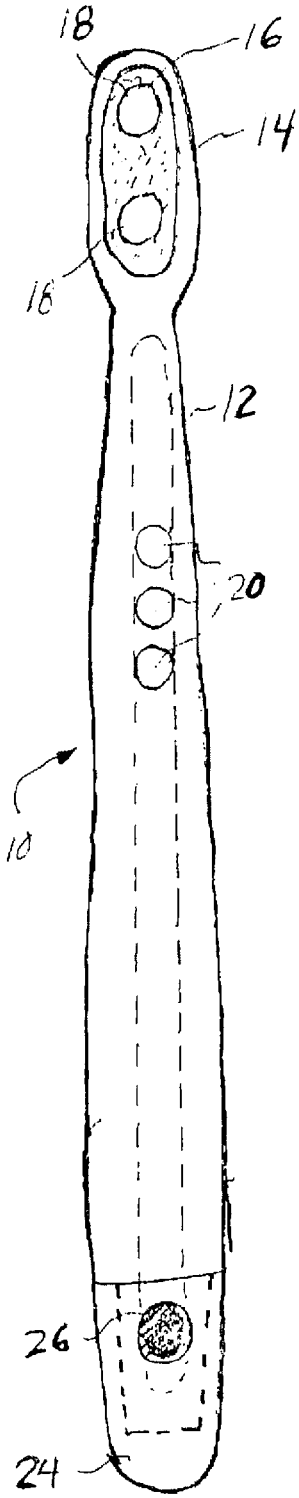
FIG. 2 is a plan view of a tooth brush according to this invention, partially broken away to enhance understanding of its construction, showing the brush pockets and showing the end cap in open position.

As shown in FIGS. 1 and 2, a tooth brush 10 of this invention has a handle 12 that terminates at one end in a head 14 that mounts a plurality of bristles that form a brush 16 having a face 17 for engaging a person's teeth (not illustrated) for cleaning in a well-known manner. A pair of spaced, generally part-spherical pockets 18 are formed in the brush face, as best seen in FIG. 2, for receiving spherical dentifrice pellets 20, as detailed later.

Figure 3:
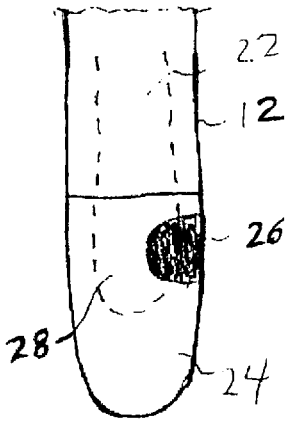
FIG. 3 is a detail view of the end of the tooth brush of FIG. 2, illustrating the end cap in closed position'

Handle 12 includes a cylindrical storage chamber 22 extending to handle end that rotatably receives an end cap 24. An entry hole 26 is formed in end cap 24, which can be twisted to an open position registering entry hole 26 with a radial entry port 28 that opens into storage chamber 22, as shown in FIG. 2. This allows a number of the dentifrice pellets 20 to be loaded into chamber 22, whereupon end cap 24 can be twisted to a closed position, as seen in FIG. 3, with entry hole 26 out of registry with entry port 28, thus confining dentifrice pellets within storage chamber 22, and excluding water therefrom.

Figure 4:
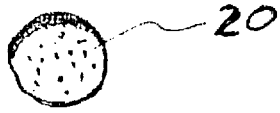
FIG. 4 is a plan view of a tooth paste pellet according to this invention, shown in solid form.
Figure 5:
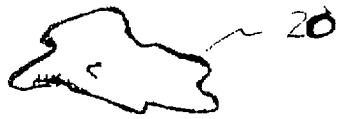
FIG. 5 is a view of the pellet of FIG. 4 shown in gel form after wetting.

When a person desires to brush his/her teeth, end cap 24 is twisted to open position and two dentifrice pellets 20 are withdrawn from storage chamber 22 through entry port 28 and entry hole 26. Pellets 20 are in a solid dehydrated form in a spherical shape, as shown in FIG. 4. Other shapes could be used, such as ovoid, rounded square, etc. However since they can roll, this facilitates handling and storage in chamber 22. When wetted, a pellet will hydrate into a flowable gel form shown in FIG. 5.

Figure 6:
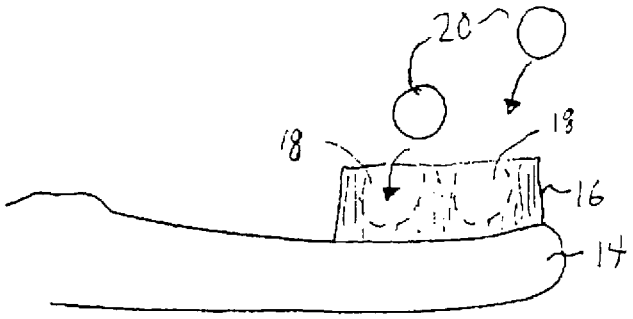
FIG. 6 is a detail view of the tooth brush of FIGS. 1 and 2, showing insertion of tooth paste pellets into the brush pockets.
Figure 7:
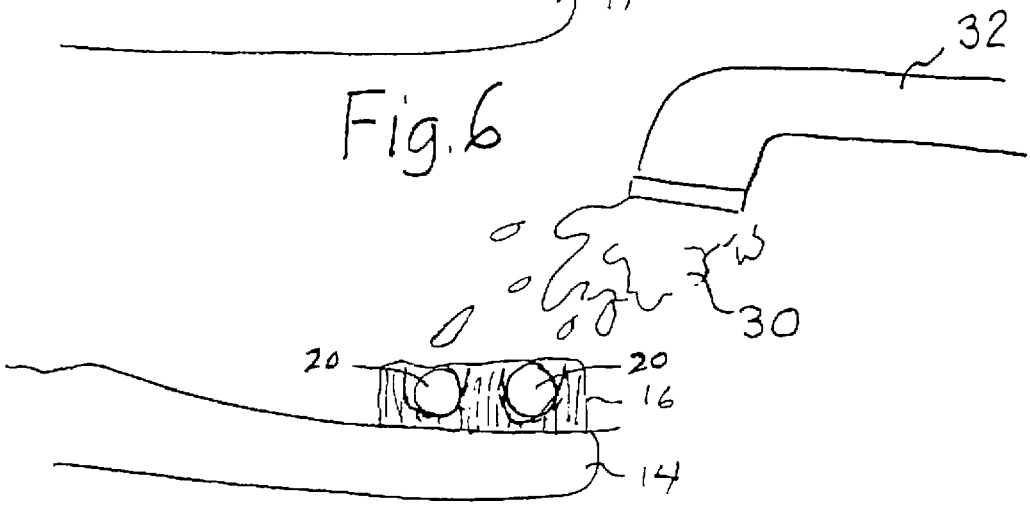
FIG. 7 is a view similar to FIG. 6, showing the pellets in the pockets and the brush being wetted.
Figure 8:
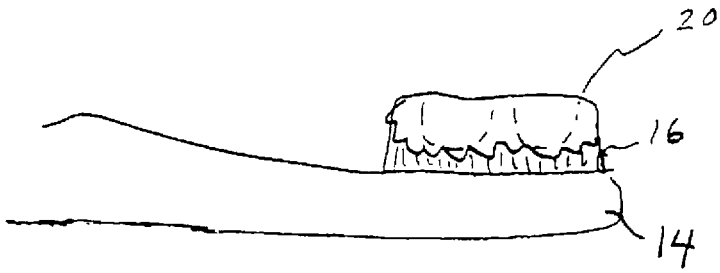
FIG. 8 is a view similar to FIG. 7, showing the pellets turned to a gel after wetting.

Referring now to FIGS. 6, 7 and 8, tooth brush 10 is then turned to a horizontal position with brush face 17 up, and a dentifrice pellet 20 is placed in each pocket 18. The pellets 20 and brush 16 are wetted with water 30 from a faucet 32, turning the pellets into a flowable gel, as shown in FIG. 8. Tooth brushing then proceeds as normal.

There are several advantages to this arrangement. One is that the correct amount of dentifrice is always used, thus preventing wastage or brushing with too little dentifrice to be effective. Another is that dentifrice is always handy, since it is carried in the tooth brush handle. A further advantage is that dentifrice pellets can be selectively colored and/or flavored by the manufacturer. This provides a vast variety of different flavors and colors that can be used alternately, making brushing a fun event for children and promoting better dental hygiene. A yet further advantage is that it is ideal for travel, especially camping, since a separate tube or canister of dentifrice need not be packed, conserving weight and space.

Although only a preferred embodiment has been described and shown, obvious modifications are contemplated within the scope of this invention and appended claims. For example, the pellets and brush pockets could have different shapes or they both could have the same different (from part-spherical) shape. Also, the end cap could be longitudinally slidable on the handle end, rather than rotatable.

I claim:

1. A dental cleaning system comprising a toothbrush having a handle with first and second ends, with a plurality of upstanding bristles extending from the area of the first end in generally parallel fashion that have distal ends forming a brush surface adapted to engage a person's teeth for cleaning, a pocket formed in the brush surface, an elongated hollow storage chamber enclosed within the handle for storing dentifrice pellets, a number of dentrifice pellets shaped for reception in said pocket for wetting and teeth cleaning loaded within said chamber, and means at the second handle end for selectively dispensing said dentifrice, wherein said hollow storage chamber in the handle has an entry port, and the dispensing means comprises a cap movably carried by the second handle end and having an entry hole that is movable into and out of registry with the entry port.

2. The dental cleaning system of claim 1, wherein said hollow storage chamber in the handle internal cross section is cylindrical in shape.

3. The dental cleaning system of claim 1, wherein said dentifrice pellets can be selectively colored and/or flavored.

4. The dental cleaning system of claim 1, wherein the dentifrice pellets have an initial solid form, for ease of handling, until wetted, whereupon the dentifrice pellets become a flowable gel.

5. The dental cleaning system of claim 1, wherein said dentifrice pellets are spherical in shape.

6. The dental cleaning system of claim 1, wherein a second pocket is formed in the brush surface for receiving a second pellet.

7. The dental cleaning system of claim 1, wherein the cap is longitudinally slidable on the handle second end.

8. The dental cleaning system of claim 1, wherein the cap is rotatable on said hollow handle second end.

9. The dental cleaning system of claim 8, wherein said hollow storage chamber in the handle internal cross section is cylindrical in shape.

10. The dental cleaning system of claim 8, wherein said dentifrice can be selectively colored and/or flavored.

11. The dental cleaning system of claim 8, wherein the dentifrice pellets have an initial solid form, for ease of handling, until wetted, whereupon the dentifrice pellets become a flowable gel.

12. The dental cleaning system of claim 8, wherein said dentifrice pellets are spherical in shape.

13. The dental cleaning system of claim 8, wherein a second pocket is formed in the brush surface for receiving a second pellet.

* * * * *